United States Patent [19]

Nischwitz

[11] 4,273,552

[45] Jun. 16, 1981

[54] PROCESS FOR THE PRETREATMENT OF CELLULOSE FIBERS TO BE PRINTED ACCORDING TO THE THERMOTRANSFER PRINTING METHOD

[75] Inventor: Ehrenfried Nischwitz, Schmitten, Fed. Rep. of Germany

[73] Assignee: Hoechst Aktiengesellschaft, Fed. Rep. of Germany

[21] Appl. No.: 75,328

[22] Filed: Sep. 12, 1979

[30] Foreign Application Priority Data

Sep. 16, 1978 [DE] Fed. Rep. of Germany ..... 2840438

[51] Int. Cl.[3] ..... D06P 1/00; B05D 3/02; B05D 3/00

[52] U.S. Cl. ..... 8/471; 8/495; 427/315; 427/316; 427/324; 427/377; 427/389.9; 427/392; 526/320

[58] Field of Search ..... 427/315, 316, 324, 377, 427/390 R, 392, 389.9; 8/2.5 A, 495, 471; 526/320

[56] References Cited

U.S. PATENT DOCUMENTS

| | | | |
|---|---|---|---|
| 3,661,827 | 5/1972 | Taft | 526/320 X |
| 3,707,346 | 12/1972 | Markert et al. | 8/2.5 A |
| 3,829,286 | 8/1974 | Anzai et al. | 8/2.5 A |
| 3,880,956 | 4/1975 | Skoultchi | 526/320 |
| 4,065,598 | 12/1977 | Takahashi et al. | 526/320 X |

*Primary Examiner*—Michael R. Lusignan
*Attorney, Agent, or Firm*—Connolly and Hutz

[57] ABSTRACT

A process for the pretreatment of cellulose fibers which are printed according to the thermotransfer printing process, which comprises impregnating the fiber material with a solution or dispersion containing a compound of the formula in which x is 2 or 3, A represents—if x=2—a group of the formula or -if x=3 —represents a group of the formula W is a group of the formula —$CH_2$—or R is hydrogen or methyl, m is a number of from 1 to 30, preferably from 4 to 11, and n is a number of from 1 to 30, preferably from 1 to 10, as well as a polymerization catalyst, and steaming and drying the material.

1 Claim, No Drawings

PROCESS FOR THE PRETREATMENT OF CELLULOSE FIBERS TO BE PRINTED ACCORDING TO THE THERMOTRANSFER PRINTING METHOD

It has already been proposed to print textile material according to the so-called thermotransfer printing process, wherein the dyestuff is printed at first onto an auxiliary carrier, for example paper. The printed auxiliary carrier is then contacted with the textile material to be printed under pressure and at elevated temperature, whereupon the dyestuff diffuses from the carrier into the textile material. Suitable dyestuffs for this process are essentially only disperse dyes, i.e. those which are sublimable to a certain degree. Said thermotransfer printing process is also restricted to polyester, polyamide, polyacrylonitrile and cellulose acetate fibers, since only these materials permit a transfer of the disperse dyes without difficulty, while ensuring a sufficient fixation of the dyes in the fiber. Cellulose fibers on the other hand do not show any affinity to disperse dyes, so that a dyestuff transfer to cellulose is effected only to a very small extent, the dyestuff transferred is not fixed and is removed almost entirely with the first washing. In order to print textile material of cellulose fibers or of mixtures of synthetic fibers and a predominant portion of cellulose fibers with disperse dyes according to the thermotransfer printing process, a pretreatment of said material is required.

In German Offenlegungsschrift No. 2,418,519 there has already been described the pretreatment of textile material of cellulose fibers with polyols or the ethers and esters thereof. However, according to the process described therein, the said compounds are merely dried on the textile material. Yet in this form the compounds applied remain water-soluble, so that a color pattern printed onto a fabric thus pretreated according to the thermotransfer printing process is already largely washed out in the first washing.

It has now been found that the disperse dyes common in the thermotransfer printing process may also be fixed onto cellulose fibers with a good fastness to washing, if the textile material is treated with polymerizable compounds, which compounds are not only dried, as has been described in the above Offenlegungsschrift, but are polymerized on the textile material.

Thus, the subject of the invention is a process for the pretreatment of cellulose fibers which are printed according to the thermotransfer printing process, which comprises impregnating the fiber material with a solution or dispersion containing a compound of the formula

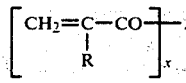

in which x is 2 or 3, A represents—if x=2—a group of the formula

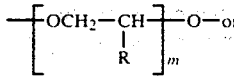

-continued

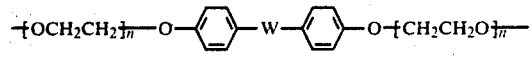

or—if x=3—represents a group of the formula

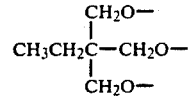

W is a group of the formula —$CH_2$— or

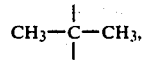

R is hydrogen or methyl, m is a number of from 1 to 30, preferably from 4 to 11, and n is a number of from 1 to 30, preferably from 1 to 10, as well as a polymerization catalyst, and steaming and drying the material.

Suitable textile materials are fabrics, knitted fabrics and non-wovens which either consist entirely of cellulose fibers or represent fiber mixtures of cellulose fibers and synthetic fibers, the portion of synthetic fibers being up to 50%. It goes without saying that also textiles having a lower cellulose portion or textiles made of synthetic fibers only may be pretreated with the above-mentioned products, but the pretreatment is superfluous for these articles in practice, as the high portion of synthetic fibers allows of good and wash-fast thermotransfer prints owing to the high affinity of these fibers to disperse dyes. As cellulose fibers there may be mentioned predominantly cotton, rayon staple and filaments, but also linen, jute, etc.

This textile material is impregnated according to common processes, for example by padding, slop-padding or spraying with an aqueous solution or dispersion of a (meth)acrylic acid ester of the above formula, while adding a polymerization catalyst. Instead of a purely aqueous solution or dispersion there may also be used solutions of the esters in a mixture of water and lower alcohols, preferably isopropanol. Suitable (meth)acrylic acid esters are, for example, the following products: polyethylene-glycol (MW 250) diacrylate, polyethylene-glycol (MW 250) dimethacrylate, polyethylene-glycol (MW 400) diacrylate, polyethylene-glycol (MW 400) dimethacrylate, polypropylene-glycol (MW 430) diacrylate, polypropylene-glycol (MW 430) dimethacrylate, polypropylene-glycol (MW 600) diacrylate and polypropylene-glycol (MW 600) dimethacrylate. There are furthermore mentioned the corresponding monoacrylates and monomethacrylates, especially polyethylene-glycol (MW 1000) monomethacrylate and the mixtures of mono- and diesters. Equally appropriate esters are trimethylol-propane triacrylate and trimethylol-propane trimethacrylate as well as the mono- and di(meth-)acrylic acid esters of bis-(p-hydroxyphenyl)methane and 2,2-bis-(p-hydroxyphenyl)-propane.

The impregnation bath contains generally from 60 to 400, preferably from 80 to 220 g/l of these (meth)acrylic acid esters as well as from 2 to 10 g/l of the catalyst. As catalysts there are suitable peroxy compounds, for example sodium, potassium or ammonium peroxide sulfate, hydroperoxide or peracetic acid.

After impregnation with this bath, the textile material is squeezed, if required, on a squeezing device, for example a padder, to a liquor pick-up of from 65 to 120%, depending on the construction of the padder and on the type of fiber, and is immediately thereafter introduced into a steamer in which the atmospheric oxygen has previously been replaced by saturated steam. The temperature in the steamer should be in the range of from 100° to 150° C., preferably from 100° to 120° C. After a dwelling time of 2 to 10 minutes—for fabrics that are not too heavy (up to 200 g/m$^2$), 3 to 5 minutes are generally sufficient—the textile article which is still moist is dried in a drying device at 100° C.

A finishing which has been effected in this manner imparts to the textile article a soft flowing feel. In order to obtain a special feel quality, textile softeners or polymer dispersions of acrylic acid ester or vinyl acetate (homo- or copolymerized), among others, may optionally be added, if they do not interfere with the polymerization on the fiber. On principle, a simultaneous polymerization of vinyl or acryl monomers and other monomers with the (meth)acrylic acid esters to be used in accordance with the invention is possible, but not advisable, since the intended effect might be impaired or nullified due to a polymerization which is difficult to control.

The pretreated textile article is ready for printing and may be printed in known manner with the aid of an auxiliary carrier (for example paper), onto which all-over or detailed color patterns have been printed, on a tailor's press or a calender, with or without applying a vacuum and at a temperature of from 120° C. to 220° C. within a period of from 10 to 90 seconds, preferably from 30 to 60 seconds.

The following Examples illustrate the present invention.

EXAMPLE 1

A cotton fabric having a surface weight of 150 g/m$^2$ is dipped into the following solution which contains 200 g/l of polyethylene-glycol (MW 400) diacrylate and 3 g/l of ammonium peroxydisulfate and is then squeezed on a padder to a liquor pick-up of 100%. The fabric which is still moist is passed through a steamer which operates with steam of 120° C. After a dwelling period of 3 minutes the fabric still moist is dried over a nozzle drier at 100° C.

The fabric thus pre-finished is treated together with a paper web printed with sublimable disperse dyes for 30 seconds at a temperature of 210° C. and under a pressure of 4 bars on a tailor's press. A soft and slightly full fabric is obtained which has been printed with a good color depth. This color depth is only slightly reduced even after three machine washings at 60° C.

If a cotton fabric is finished with polyethylene-glycol (MW 400) instead of polyethylene-glycol (MW 400) diacrylate, the print which is strong at first can hardly be recognized already after one washing.

EXAMPLE 2

A knitted fabric made of cotton is finished as in Example 1. The finishing bath contains 220 g/l of trimethylol-propane triacrylate and 5 g/l of potassium peroxydisulfate. After printing, the looped fabric shows a finely-detailed pattern of a good color depth, which does hardly show a reduction in strength even after 3 machine washings at 40° C.

EXAMPLE 3

A polyester-cotton fabric (50/50) having a surface weight of 180 g/m$^2$ is finished as in Example 1. The impregnation bath contains 140 g/l of polypropylene-glycol (MW 600) dimethacrylate and 3 g/l of ammonium peroxydisulfate. After printing, a strong brilliant pattern is obtained on the fabric which is not reduced in strength even after 3 machine washings at 60° C.

EXAMPLE 4

A non-woven carded article prepared from 80 parts of rayon staple and 20 parts of polyester fibers, which has been hardened by impregnation with a commercial acrylic ester dispersion and which shows a surface weight of 80 g/m$^2$, is treated according to the method indicated in Example 1 with a bath containing the following products:

160 g/l of an addition product of bisphenol A (4,4'-dihydroxy-diphenyl methane) with 2 mols of ethylene-glycol which has been esterified on either side with acrylic acid 9 g/l of hydrogen peroxide (30% strength)

10 g/l of a 25% emulsion of a mixture of glycerol monostearate and polyethylene-glycol (MW 1000) monostearate.

The finished non-woven article was printed at 210° C. within 60 seconds under a vacuum applied from the back (44.15 mbars).

There is obtained a non-woven article wherein the pattern has penetrated the material with a good color strength. This color strength is not reduced after 3 machine light duty washings at 40° C. The feel of the article becomes softer and more flowing as compared with an unfinished article.

EXAMPLE 5

A cotton fabric is finished as has been described in Example 1. The finishing bath contains 150 g/l of polyethylene-glycol (MW 250) diacrylate, 40 g/l of a 40% aqueous dispersion of a copolymer of butyl acrylate/acrylonitrile/acrylic acid (95/5/3) and 3 g/l of ammonium peroxydisulfate. After the thermotransfer printing there is obtained a fabric with a strong brilliant print and a full elastic feel, which qualities are maintained unaltered after 3 machine washings at 60° C.

EXAMPLE 6

A PES/cotton fabric as described in Example 3 is finished as has been indicated in Example 1. The finishing bath is composed as follows: 140 g/l of polyethylene-glycol (MW 1000) monomethacrylate, 3 g/l of ammonium peroxydisulfate and 40 g/l of a 50% aqueous dispersion of a copolymer of vinyl acetate/ethylene (84/16).

There is obtained a soft full fabric which may be printed with a brilliant color quality by way of the thermotransfer printing process. The print withstands 3 machine light duty washings at 60° C. without any reduction in strength.

What is claimed is:

1. In a process for the thermotransfer printing of cellulose fibers, the improvement which consists of printing such cellulose fibers which have been treated prior to the printing by impregnating the fiber material with a solution or dispersion containing a compound of the formula

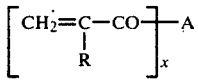
in which x is 2 or 3, A represents—if x=2—a group of the formula
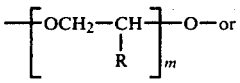
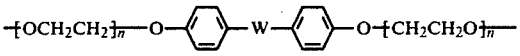
or—if x=3—represents a group of the formula
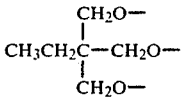
W is a group of the formula $—CH_2—$ or
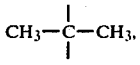
R is hydrogen or methyl, m is a number of from 1 to 30, preferably from 4 to 11, and n is a number of from 1 to 30, preferably from 1 to 10, as well as a polymerization catalyst, and steaming and drying the material.
* * * * *